US005897075A

United States Patent [19]

Elder et al.

[11] Patent Number: 5,897,075

[45] Date of Patent: Apr. 27, 1999

[54] REEL ASSEMBLY

[75] Inventors: Jack E. Elder, Rochester, Mich.; Gary L. Cox, Richmond, Ind.

[73] Assignee: Vandor Corporation, Richmond, Ind.

[21] Appl. No.: 08/866,430

[22] Filed: May 30, 1997

[51] Int. Cl.[6] ..... B65H 75/22

[52] U.S. Cl. ..... 242/608.2; 242/605; 242/614; 242/118.6

[58] Field of Search ..... 242/608, 608.2, 242/608.3, 608.6, 608.7, 118.6, 118.61, 605

[56] References Cited

U.S. PATENT DOCUMENTS

| | | | |
|---|---|---|---|
| 1,333,162 | 3/1920 | Cook, Jr. . | |
| 1,588,228 | 6/1926 | Hotchkiss . | |
| 1,679,573 | 8/1928 | Hind . | |
| 1,811,517 | 6/1931 | Mossberg | 242/605 |
| 1,868,634 | 7/1932 | Gregory . | |
| 1,904,027 | 4/1933 | Field . | |
| 2,233,449 | 3/1941 | Glenny . | |
| 2,856,137 | 10/1958 | Howsam . | |
| 2,977,066 | 3/1961 | Kimmel | 242/609 |
| 3,661,341 | 5/1972 | Eifrid . | |
| 4,189,823 | 2/1980 | Neyenhuys | 242/118.6 |
| 4,345,724 | 8/1982 | Lindell . | |
| 4,422,595 | 12/1983 | Thomas | 242/118.61 |
| 4,715,556 | 12/1987 | Tack et al. | 242/118.6 |
| 5,605,305 | 2/1997 | Picton | 242/608 |

FOREIGN PATENT DOCUMENTS

| | | | |
|---|---|---|---|
| 0 556 154 A1 | 8/1993 | European Pat. Off. | 242/608.2 |
| 1036012 | 9/1953 | France . | |
| 1379003 | 10/1964 | France | 242/118.61 |

*Primary Examiner*—John P. Darling
*Attorney, Agent, or Firm*—Maginot, Addison & Moore

[57] ABSTRACT

An apparatus for supporting wound flexible media includes first and second flanges, a core, and at least one single piece connector. The core is interposed between said first flange and said second flange. The first flange has at least one aperture and at least one protruding feature corresponding to said aperture. The at least one single piece connector includes a first interlocking end that extends through an aperture of the second flange and through the at least one aperture of the first flange, wherein said first interlocking end engages the protruding feature to inhibit a de-insertion alignment of the first interlocking end with the at least one aperture.

37 Claims, 7 Drawing Sheets

REEL ASSEMBLY

FIELD OF THE INVENTION

The present invention relates generally to reels for supporting or storing flexible media.

BACKGROUND OF THE INVENTION

Reels for storing flexible media, such as wire, hose, fabric, chain link, or rope, typically comprise a core interposed between two flanges. In general, the flexible media is wound or wrapped around the core and held in place by the flanges. Reels intended for industrial transport, storage and use of flexible media vary greatly in size. Reels have traditionally been fabricated out of wood or metallic material, and have more recently been fabricated from paper and plastic products.

Ideally, a reel combines structural strength with simplicity and economy of manufacture. One commercially available reel design that combines strength with simplicity is a common wood reel. Wood reels typically include a wooden core, a pair of wooden flanges, long bolts and matching nuts. The long bolts and matching nuts secure the flanges to the core. Specifically, one or more bolts are inserted through one flange, through the core, and outward the other flange. A nut is then rotatably tightened on the protruding bolt, thereby securing or trapping both flanges to the core.

A significant drawback of the nut and bolt flange securing design described above relates to the reliability of the resulting reel. Specifically, the conditions under which reels are transported and stored often causes loosening of the nuts. For example, a reel manufactured under environmental conditions in one manufacturing facility may subsequently be shipped in a vehicle, train or ship having higher or lower temperatures and/or humidity. Accordingly, the reel is often exposed to severe climate changes during shipment. The severe climate changes can cause the reel structure to expand and contract repeatedly, which in turn can cause loosening of the nuts on the bolts. Vibration during shipment can also contribute to the loosening of the nuts. A loosened nut can produce catastrophic results to the end user. In particular, users of industrial reels often employ high speed winding machines to wind the flexible media onto the reel. If the nuts that secure the flange to the core are loosened during shipment, the operation of the high speed winding machine can further loosen the nut until the flanges become disengaged from the core. The disengagement of the flange during the winding operation can cause significant production delays and possible injury.

Similarly, reels with finished goods, in other words, reels that have already been wound, may undergo similar thermocycling and/or humidity cycling which could cause the nuts to loosen. Failure of reels with finished goods can have similar catastrophic consequences.

Accordingly, it is desirable to utilize reels that rely on connecting techniques that are alternative to the nut and bolt design. U.S. Pat. No. 2,856,136 to Howsam employs such an alternative flange securing design. Specifically U.S. Pat. No. 2,856,136 describes a disposable reel that includes a frame having a plurality of axially extending rods that extend through the flanges of the reel and are bent against the outside of each flange to secure the flange to the central core. To construct the reel, the flanges are place over the rod ends such that the rod ends extend outward the flanges. A circular wire hoop is then spaced radially outward the extending rod ends on the flanges. The rod ends are then bent over the wire hoop at each flange to secure the flange to the core of the reel.

A drawback to the reel design described in U.S. Pat. No. 2,856,136 is its complexity of manufacture. Specifically, the placement of the circular hoop and the bending of the various rod ends over the hoop requires potentially time-consuming manufacturing steps. Furthermore, the disclosed frame structure itself includes eight rods and three circular hoops in addition to the two wire hoops discussed above. Thus, the frame itself raises manufacturing complexity issues. Moreover, combination of eight rods and five hoops adds to the material cost of the reel manufacture.

Accordingly, there is a need for a simple, structurally sound wire reel that uses a flange connection mechanism that is alternative to the nut and bolt combination of the prior art. Such a reel design should advantageously have reduced material cost and simplicity of manufacture.

SUMMARY OF THE INVENTION

The present invention fulfills the above stated needs, as well as others, by providing a reel comprising a core, at least one connecting rod, and two flanges, each flange having a protruding feature for engaging an interlocking end of each connecting rod. The interlocking end of the connecting rod may suitably be inserted through an aperture and then moved or shifted to traverse the protruding feature such that the protruding feature inhibits the de-insertion alignment. The use of the protruding feature to inhibit de-insertion alignment eliminates the need for permanently bending or deforming the connecting rod end during assembly of the reel to secure the flange to the core.

In one embodiment of the present invention, an apparatus for supporting wound flexible media includes first and second flanges, a core, and at least one single piece connector. The core is interposed between said first flange and said second flange. The first flange has at least one aperture and at least one protruding feature corresponding to said aperture. The at least one single piece connector includes a first interlocking end that extends through an aperture of the second flange and through the at least one aperture of the first flange, wherein said first interlocking end engages the protruding feature to inhibit a de-insertion alignment of the first interlocking end with the at least one aperture.

An exemplary method according to the present invention includes a method of constructing a reel comprising a core, first and second flanges, and at least one single piece connector having a first interlocking end. The method includes first disposing the core between the first flange and the second flange and then inserting the first interlocking end through, in sequence, an aperture in the second flange, an interior of the core body, and an aperture in the first flange, such that the first interlocking end extends outward the first flange. Then, the method includes the step of causing the first interlocking end to traverse a protruding feature in the first flange to a position in which the protruding feature in the first flange inhibits the first interlocking end from de-insertion alignment with the aperture in the first flange.

The present invention thus provides a structurally sound alternative to the nut and bolt configuration for securing the flanges to the core of a reel assembly that affords economical manufacture. For example, the reel of the present invention does not require permanently bending or deforming the connectors after assembling the flanges about the core. Specifically, the aperture in the flange in the present invention is large enough to receive the connector and interlocking end in its final shape because the protruding feature on the flange retains the interlocking end to prevent the connector from slipping back through aperture. By contrast, prior art designs relied on bending the connector after insertion through the aperture to hold the connector in place. The elimination of the need for bending after insertion reduces the complexity of manufacture.

The above features and advantages, as well as others, will become readily apparent to those of ordinary skill in the art by reference to the following detailed description and accompanying drawings.

DETAILED DESCRIPTION

Figure 1:
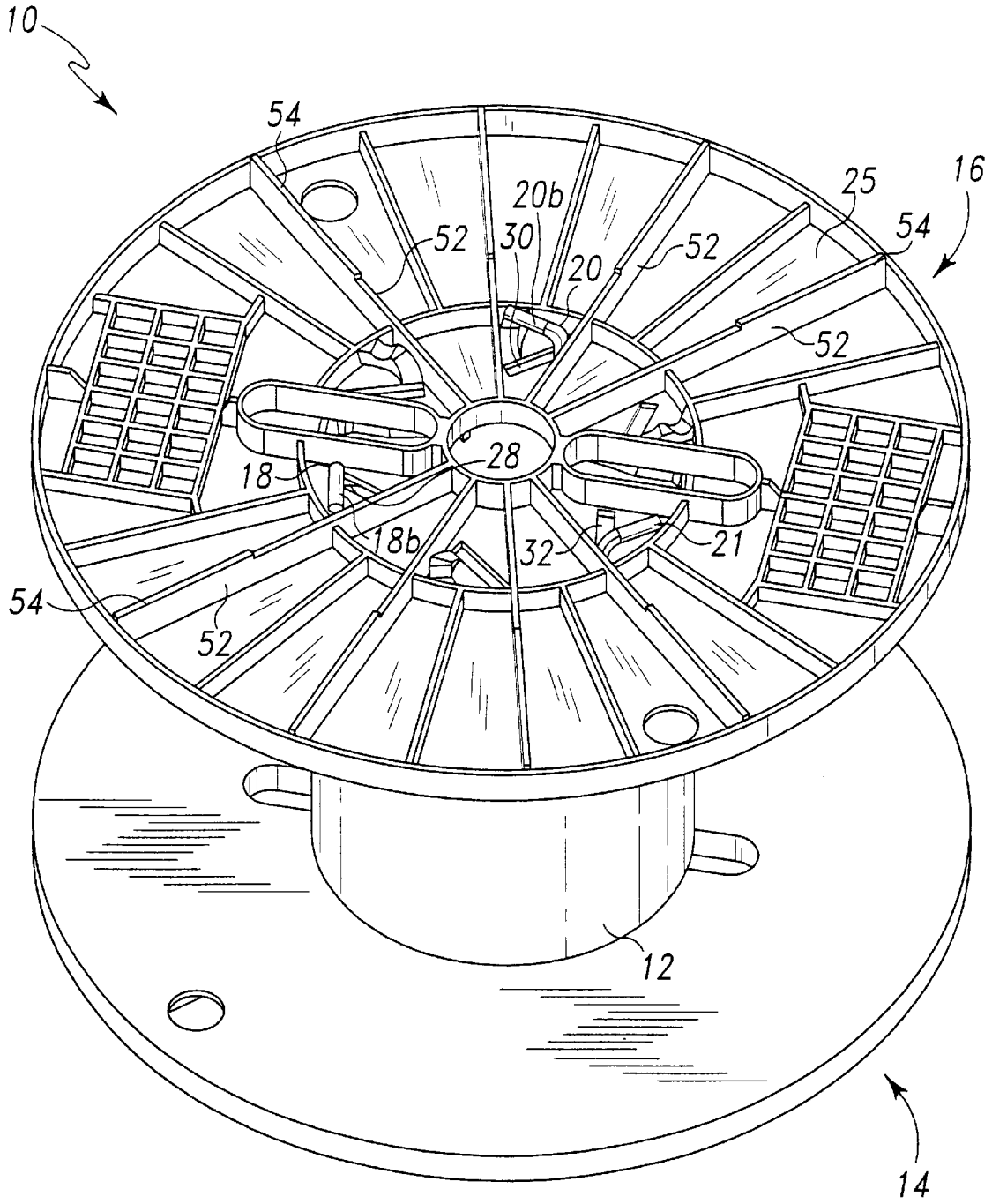
FIG. 1 illustrates a perspective view of an exemplary reel assembly which incorporates the features of the present invention.
Figure 1A:
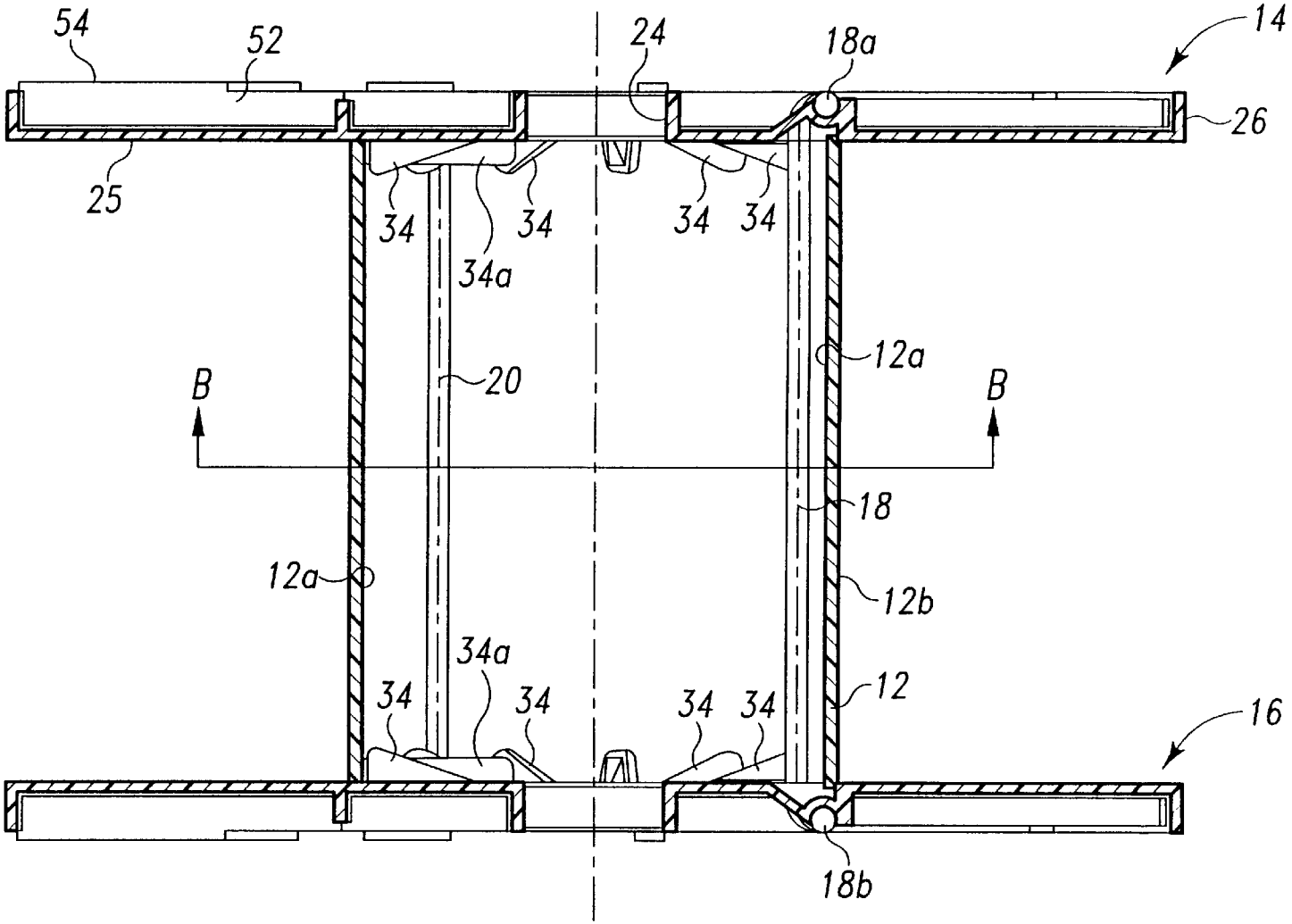
FIG. 1A illustrates a cross-sectional view of the exemplary reel assembly of FIG. 1.
Figure 2:
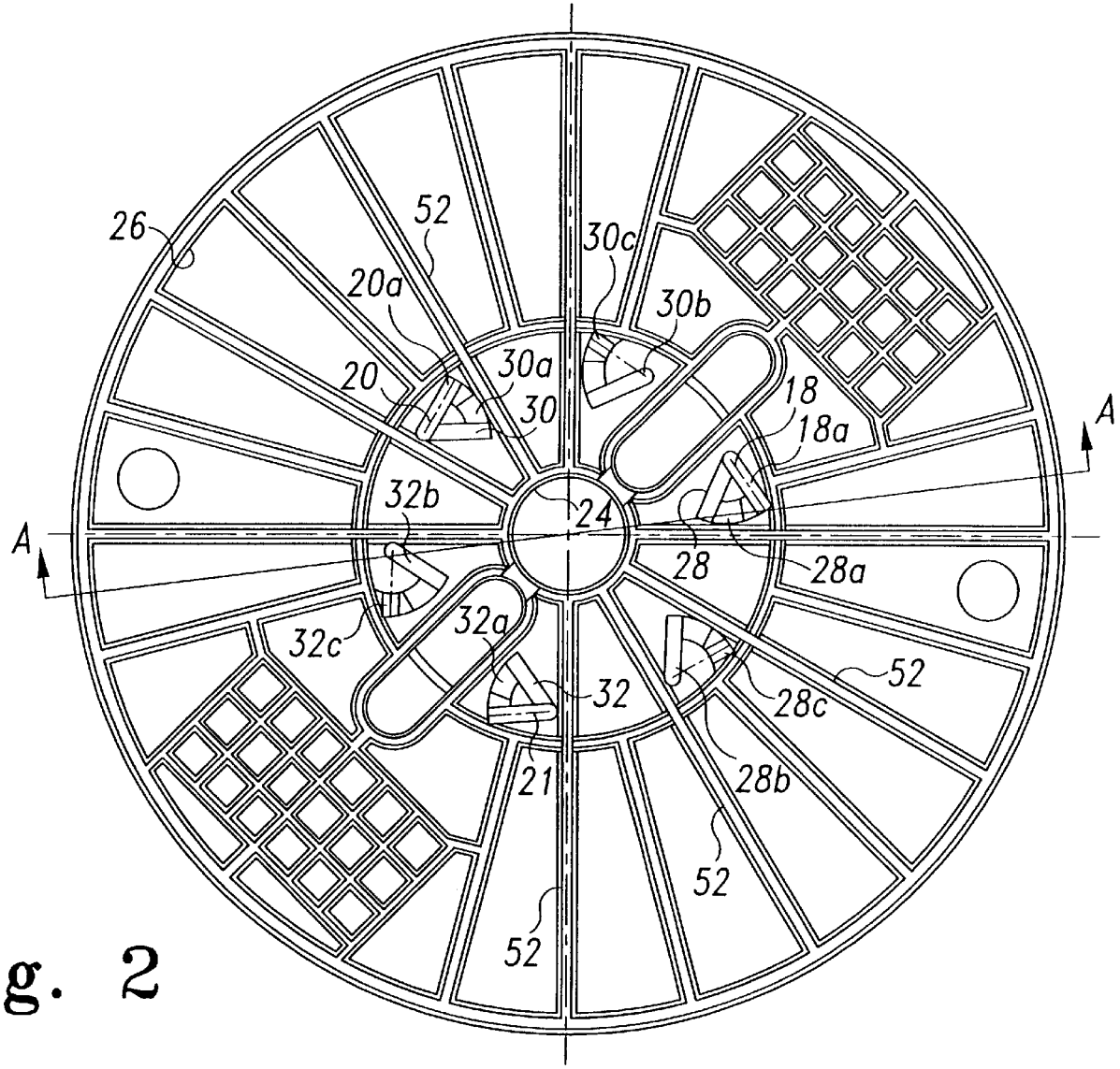
FIG. 2 illustrates a top elevational view of the reel assembly of FIG. 1, including the first side of a flange according to the present invention.
Figure 5:
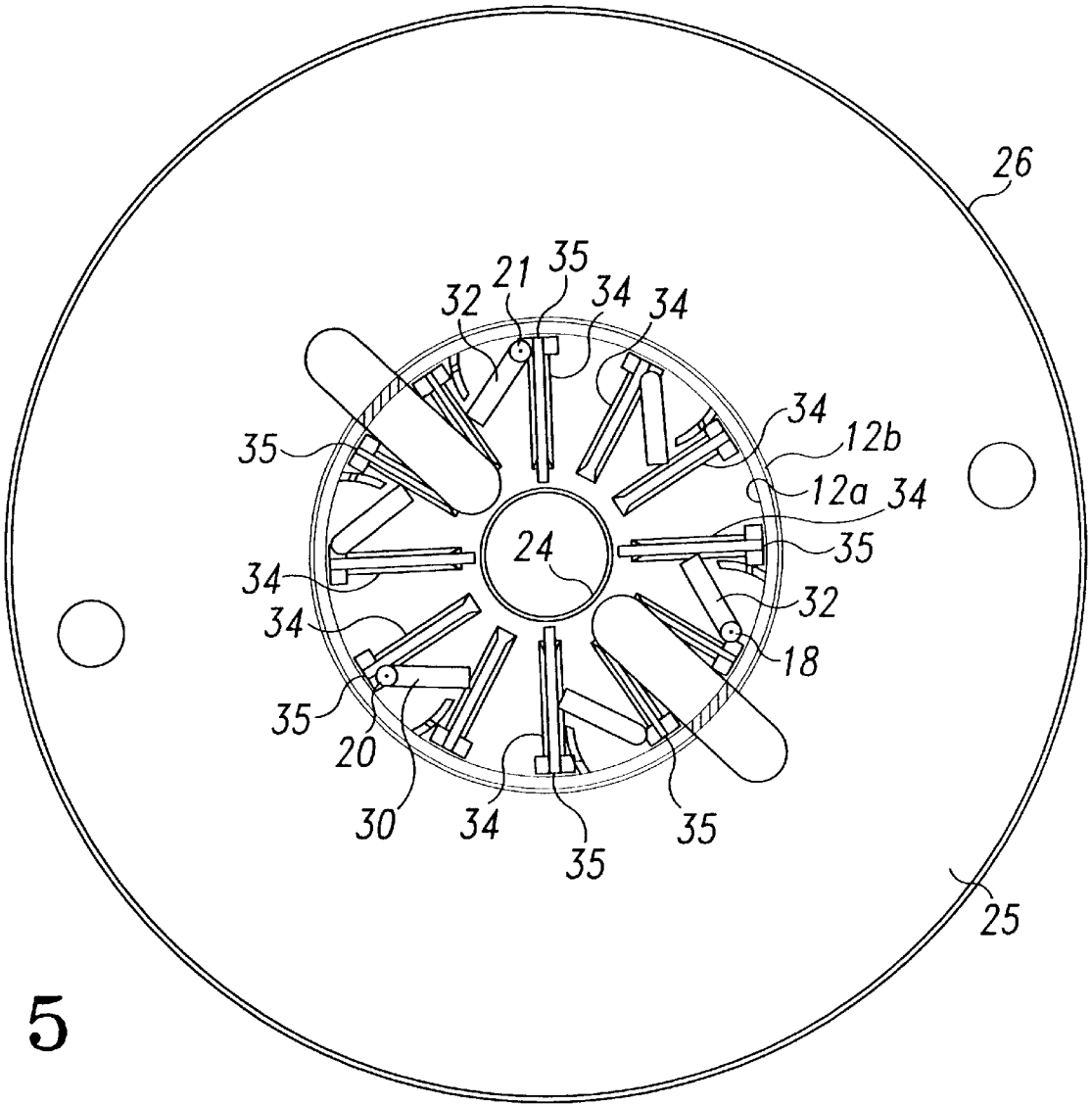
FIG. 5 illustrates a cross section of the reel assembly of FIG. 1 including the second side of a flange according to the present invention.

Reference is made to FIGS. 1, 1A, 2 and 5 to describe generally an exemplary embodiment of a reel assembly according to the present invention. FIG. 1 illustrates a perspective view of an exemplary reel 10 according to the present invention. FIG. 2 illustrates a top view of the reel 10. FIG. 1A illustrates a cross sectional view of the reel 10, and in particular, represents section A of FIG. 2. FIG. 5 shows a cross sectional view of the exemplary reel assembly, and in particular, section B of FIG. 1A.

The exemplary reel comprises a core 12, a first flange 14, a second flange 16, and at least one single piece connector, and in the present embodiment, a first single piece connector 18, a second single piece connector 20, and a third single piece connector 21. The core 12 comprises a hollow cylindrical body having an inner surface 12*a* and an outer surface 12*b*. The core 12 is preferably constructed out of a lightweight material such as pressed paper. In alternative embodiments, the core 12 may suitably have an alternative shape, for example, a shape having a noncircular cross section. Thus, for example, the core may have an octagonal cross section or hexagonal cross section. In general, any core having a shape and structure around which flexible media may be wound is suitable for use in a reel assembly according to the present invention. Moreover, the core 12 may alternatively be constructed of wood, plastic or metallic material, if the use of such material is desirable for a particular application.

Referring specifically to FIG. 2, the first flange 14 comprises an annulus 25 having an inner annular rim 24 defining an inner edge and an outer annular rim 26 defining an outer edge. The inner annular rim 24 and outer annular rim 26 both extend axially upward from a first side of the annulus 25. The first flange 14 includes a plurality of apertures through the annulus 25, exemplified by first, second and third apertures 28, 30, and 32, respectively. The first flange 14 further includes a plurality of protruding features, each corresponding to one of the apertures, as exemplified by protruding features 28*a*, 30*a*, and 32*a*. Each protruding feature is preferably located proximate its corresponding aperture. Thus, for example, the first protruding feature 28*a* is located proximate the first aperture 28. Further detail regarding the first protruding feature 28*a* is provided below in connection with FIG. 3.

In a preferred embodiment, the first flange 14 includes a set of matching apertures 28*b*, 30*b*, and 32*b*, and corresponding protruding features 28*c*, 30*c*, and 32*c*, that facilitate a single flange design, as will be discussed below. Each of the matching apertures 28*b*, 30*b*, and 32*b* have substantially similar dimensions as the first aperture 28. Each of the matching apertures 28*b*, 30*b*, and 32*b* are disposed in a location and orientation that causes the matching apertures 28*b*, 30*b*, and 32*b* to each be in registration with the apertures 28, 30, and 32 of a similarly-structured flange oriented in an opposite direction. Likewise, each of the matching protruding features 28*c*, 30*c*, and 32*c* have substantially similar dimensions as the first protruding feature 28*a*, and each is disposed in a location and orientation to be in registration with protruding features 28*a*, 30*a*, and 32*a*, respectively, of a similarly-structured flange oriented in an opposite direction.

The purpose of the matching apertures 28*b*, 30*b*, and 32*b* and the matching protruding features 28*c*, 30*c*, and 32*c* is to enable the first flange 14 to mate with another substantially identical flange in the reel assembly 10. The matching apertures 28*b*, 30*b*, and 32*b* and matching protruding features 28*c*, 30*c*, 32*c*, are disposed such that they will align with the apertures 28, 30 and 32 of an identically structured flange oriented in the opposite direction, as when assembled into a reel. In this manner, any flange may be mated with any other flange, which eliminates the need to track and inventory separate parts for the two flanges.

The first flange 14 also preferably includes a plurality of radial support ridges 52 that extend from the inner annular rim 24 to the outer annular rim 26. The plurality of radial support ridges generally have an axial height not exceeding the inner annular rim 24 and outer annular rim 26. The first flange 14 also includes a plurality of ribs 54 that may extend axially above the annular rims 24 and 26. The plurality of ribs 54 are preferably disposed such that at least a portion of each of the plurality of ribs extends to the inner extreme of the outer annular rim 26. The plurality of ribs 54 may suitably comprise an axial extension of one or more of the radial support ridges 52. As will be discussed further below, the plurality of ribs 54 facilitates the stacking reels by holding the first flange 14 in registration with a flange of another reel, not shown, that is stacked on top of the reel 10.

Referring specifically to FIGS. 1A and 5, the first flange 14 also includes a plurality of radially extending shoulders 34 located on a second side of the annulus 25. The second side of the annulus 25 is the side opposite the first side that includes the protruding features 28*a*, 30*a*, and 32*a*. The plurality of shoulders 34 are arranged spaced apart to form a broken circle. Each of the plurality of shoulders 34 terminates in a radial core engaging surface 35. The radial core engaging surfaces 35 are discussed in further detail below in connection with FIG. 6. In general, however, the radial core engaging surfaces 35 engage the inner surface 12*a* of the core 12.

The annulus 25, the first, second, and third protruding features 28*a*, 30*a*, and 32*a*, respectively, the first, second and third matching protruding features 28*c*, 30*c*, and 32*c*, respectively, the radial support ridges 52, the plurality of ribs 54 and the radially extending shoulders 34, are preferably integrally formed. For example, the first flange 14, including its various structures listed above, may suitably be constructed of an integrally formed piece of injected molded plastic.

In the alternative, the various structures of the first flange 14 may be securely affixed to the annulus 25 in another manner. For example, if the annulus 25 is constructed of wood, the various structure, for example, the protruding features 28*a*, 30*a*, and 32*a*, may suitably be affixed to the annulus using glue, wood screws, or nails. In another example, the various structures of the first flange 14 may alternatively be integrally formed by machining the structures out of a wooden flange blank or a flange blank composed of a composite material.

In yet another example, the annulus 25 may be constructed of metallic material, and the various structures of the first flange 14 may suitably be affixed using welding or machine screws, or may alternatively be integrally formed by stamping the metallic annulus.

Figure 4:
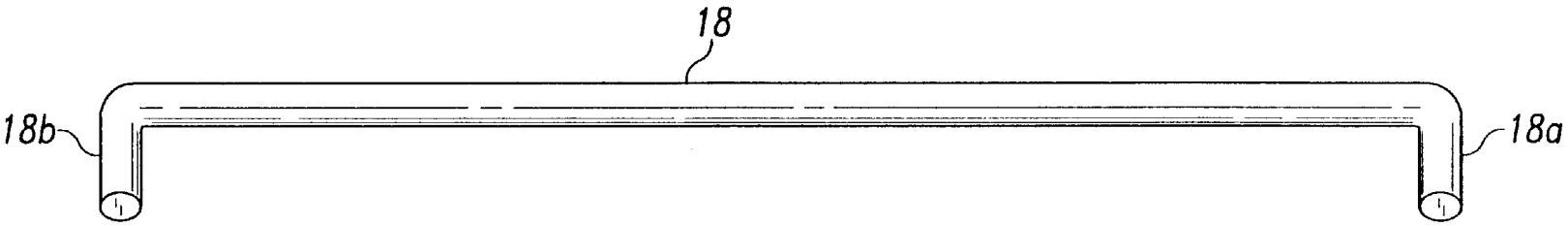
FIG. 4 illustrates one of the single piece connectors of FIG. 1.

Referring again to the exemplary embodiment described herein, the single piece connectors 18, 20 and 21 secure the first flange 14 and the second flange 16 to the core 12. FIG. 4 illustrates the connector design in detail, and specifically, illustrates the first single piece connector 18. The other connectors all suitably have a substantially similar structure. Referring to FIG. 4, first single piece connector 18 includes a first interlocking end 18*a* and preferably includes a second interlocking end 18*b*. In the exemplary embodiment described herein, the first single piece connector 18*a* comprises a steel rod and the first and second interlocking ends 18*a* and 18*b*, respectively, are angular extensions of the steel rod. Preferably, the first and second interlocking ends 18*a* and 18*b*, respectively, extend approximately 90° from the otherwise linear shape of the first single piece connector 18. To form the exemplary embodiment of the connector 18, the steel rod is pre-bent on a high-speed wire forming machine.

The length between the first interlocking end 18*a* and 18*b*, or simply connector length, should be sufficient to enable the interlocking ends to protrude the flanges of the reel when assembled. However, the connector length should be less than the length defined by the apex of the first protrusion 28*a* of the first flange 14 and the surface of the second flange 16 engaged by the second interlocking end 18*b* when the reel is assembled. As such the connector length ensures that the first protruding feature 28*a* will inhibit de-insertion alignment of the first interlocking end 18*a* with the aperture 28.

Referring again generally to both FIGS. 1A and 2, the first single piece connector 18 extends from the first flange 14 to the second flange 16, through the first aperture 28 in the first flange 14 and a similar aperture in the second flange 16, not shown, such that the first interlocking end 18*a* is disposed axially external the first flange 14 and the second interlocking end 18*b* is disposed axially external the second flange 16. It is noted that the first aperture 28 has a shape corresponding to the first interlocking end 18*a* to facilitate insertion of the first interlocking end 18*a* through the first aperture 28 during assembly. In its assembled state, as illustrated in FIG. 2, first interlocking end 18*a* engages the first protruding feature 28*a* to prevent alignment of the first interlocking end 18*a* with the first aperture 28 such that de-insertion may take place. In other words, without the protruding feature 28*a*, the first single piece connector 18 of the present embodiment could conceivably rotate such that the first interlocking end 18*a* would slip back through the aperture, or de-insert, thereby potentially causing disassembly of the reel 10. In the present embodiment, the first protruding feature 28*a* inhibits such de-insertion alignment of the first interlocking end 18*a* with the first aperture.

In the exemplary embodiment described herein, the second interlocking end 18*b* engages a similar protruding feature, not shown, on the second flange 16 for the purposes of inhibiting de-insertion alignment of the second interlocking end 18*b* with an aperture through the second flange 16, not shown. The protruding feature and corresponding aperture of the second flange 16 have substantially the same configuration as the first protruding feature 28*a* and aperture 28, respectively.

It is noted that although in the present embodiment the first flange 14 and second flange 16 have a substantially identical structure, the second flange need not include similar protruding features. For example, in an alternative embodiment, the aperture through the second flange 16 may be substantially smaller, having a size only slightly larger than the cross-sectional diameter of the first single piece connector 18. In such a case, the second flange 16 would not require a protruding feature because the aperture would not be large enough to allow de-insertion of the second interlocking end 18*b*. However, use of identical flange designs for the first flange 14 and the second flange 16 is generally desirable because it reduces cost and complexity of manufacture. Specifically, the use of a single flange design eliminates the need for separate molds and the coordination of distinct parts for stocking and assembly.

In any event, the second single piece connector 20 has substantially the same structure as the first single piece connector 18. Specifically, the second single piece connector 20 has first and second interlocking ends 20*a* and 20*b*, respectively. Moreover, analogous to the first single piece connector 18, the second single piece connector 20 extends from the first flange 14 to the second flange 16, through the aperture 30 in the first flange 14 and a similar aperture in the second flange 16, not shown, such that the first interlocking end 20*a* is disposed axially external the first flange 14 and the second interlocking end 20*b* is disposed axially external the second flange 16. The first interlocking end 20*a* engages the second protruding feature 30*a* to prevent de-insertion alignment of the first interlocking end 20*a* with the second aperture 30.

The third single piece connector 21 is similarly constructed and disposed in a manner analogous to the first and second single piece connectors 18 and 20, respectively. The first and second single piece connectors 18 and 20, respectively, and third single piece connector operate to secure the first flange 14 and the second flange 16 to the core 12.

The present invention thus provides a structurally sound alternative to the nut and bolt configuration for securing the flanges to the core of a reel assembly that affords ease of manufacture. For example, the reel of the present invention does not require permanently bending or deforming the connecting rods after assembling the flanges about the core. Specifically, the aperture in the flange in the present invention may be large enough to receive the connecting rod and interlocking end in their final shape because the protruding feature prevents the interlocking end from sliding back through the aperture, or de-inserting. By contrast, prior art designs relied on bending the connector after insertion through the aperture to hold the connector in place. The elimination of the need for bending after insertion reduces the complexity of manufacture.

Furthermore, the preferred embodiment of present invention includes only three distinct component structures including a core design, a single piece connecting rod design, and an integrally formed flange design. The use of only three component structures greatly reduces the complexity of manufacture of the reel assembly.

Another feature of the present invention is the reel nesting feature that is facilitated by the plurality of ribs 54. As discussed above, in the exemplary embodiment described herein, the plurality of ribs 54 are disposed such that they extend radially to, but inside of, the outer annular rim 26. The plurality of ribs 54 have a height that exceeds the height of the inner annular rim 24 and the outer annular rim 26. Accordingly, when another reel of like construction (and having flanges of like construction) is stacked onto the reel 10, the plurality of ribs 54 engage the outer annular rim of the other reel's flange, in order to urge and hold the first flange 14 and the flange of the other reel in registration with one another.

The registration of reels for stacking enabled by the plurality of ribs 54 facilitates added convenience for storage and transport of reels. By contrast, the stacking of prior art reels required careful placement, and careful movement of the stack, because only frictional forces prevented the stack of reels from collapsing. According to the present invention, the plurality of ribs 54 and the outer annular rim 26 inhibit stack collapse by holding the stacked reels in concentric registration with one another.

It will be noted, however, that the plurality of ribs 54 may alternatively be configured to engage the inner annular rim 24, or an annular rim disposed elsewhere on the first side of the first flange 14. It will further be noted that the benefits of the stacking features of the present invention are in not limited to reels incorporating single piece connectors, such as the reel 10. A reel having other connection means, including but not limited to nails, screws, bolts, will benefit from the inclusion of a plurality of ribs that are disposed to engage an annular rim of another reel having a similar structure for stacking purposes.

Figure 3:
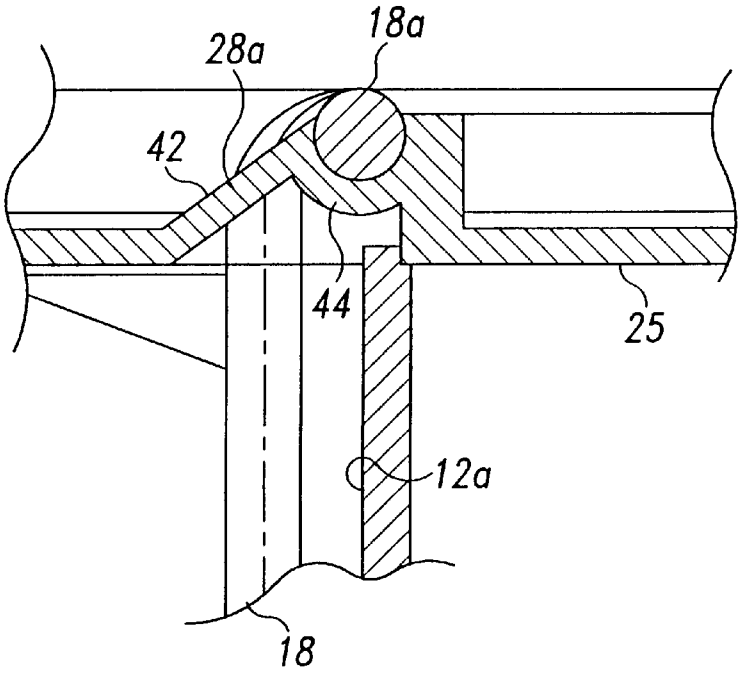
FIG. 3 illustrates a fragmentary cross-sectional view of reel assembly of FIGS. 1 and 2, and particularly, and exemplary protrusion of the flange of a reel assembly according to the present invention.

FIG. 3 illustrates a partial cross section of the exemplary first flange 14 that includes a cross section of the first protruding feature 28*a*. The protruding features 30*a* and 32*a* suitably have substantially identical structures. The structure and dimension of the first protruding feature 28*a* provide numerous advantages, however other configurations may be used to advance some of the benefits of the present invention.

The protruding feature 28*a* of the present embodiment includes a ramp portion 42 interposed between the first aperture 28 and a seating structure 44 on the protruding feature. The seating structure 44 receives the first interlocking end 18*a*, and inhibits, and preferably prevents, the first interlocking end 18*a* from migrating to the first aperture 28*a*. As will be discussed further below, the ramp portion 42 facilitates the assembly of the reel 10 (FIGS. 1A and 2) by aiding traversal of the first interlocking portion 18*a* into the seating structure 44. The engagement of first interlocking portion 18*a* with the seating structure 44 of the protruding feature 28*a* provides in part the structure that secures the first flange 14 to the core 12 (see FIG. 1A).

The present invention also provides a simple and novel method of manufacturing the reel assembly. Specifically, to manufacture the reel 10 illustrated in FIG. 1A through 4, the core 12 must first be disposed between the first flange 14 and the second flange 16. In the present embodiment, the first flange 14 is disposed adjacent to and abutting the core 12 such that the plurality of shoulders 34 abut the inner surface 12*a* of the core. The second flange 16 is similarly disposed adjacent to and abutting the axially opposite end of the core 12.

Once the first and second flanges 14 and 16 are properly positioned, the first single piece connector 18 in its final form is joined to the reel 10. In particular, the first interlocking end 18*a* is inserted, in sequence, through an aperture (not shown) in the second flange 16, an interior of the core 12, and the first aperture 28 in the first flange 14, such that the first interlocking end 18*a* extends external the first flange 14. To insert the first interlocking end 18*a* through the first aperture, the first interlocking end 18*a* must be in an insertion alignment with the first aperture.

Once the first single piece connector 18 is so inserted, the first interlocking end 18*a* is caused to traverse the first protruding feature 28*a* in the first flange 14 to a position in which the protruding feature 28*a* inhibits the first interlocking end 18*a* from de-insertion alignment (which is the same alignment as insertion alignment) with the first aperture 28. Specifically, the first single piece connector 18 is rotated such that a portion of the first interlocking end 18*a* traverses the ramp 42 (see FIG. 4). It will be noted that the first single piece connector 18 and/or the core 12 must temporarily elastically deform to allow the first interlocking end 18*a* to traverse the ramp 42. Once the first interlocking end 18*a* has traversed the ramp 42, the first single piece connector 18 and/or the core 12 elastically recoils or "snaps back" to regain some or all of its/their original shape. As a result, the first interlocking end 18*a* is forced into the seating structure 44. In such position, the protruding feature 28*a*, and specifically, the seating structure 44, inhibits the first interlocking end 18*a* from migrating back to the aperture 28, thereby inhibiting de-insertion alignment of the first interlocking end 18*a* with the first aperture 28.

While the first interlocking end is situated within the seating structure 44, the first single piece connector 18 remains under tension which helps secure the first and second flanges 14 and 16, respectively, to the core 12. Furthermore, such tension will accommodate any growth and shrinkage cycling due to climate changes during shipment or storage. Specifically, the springing action of the single piece connector 18 allows for expansion of the reel 10 by further elastic deformation, and also allows for contraction of the reel through the springing force. Accordingly, the reel 10 remains securely assembled despite harsh shipment and storage conditions.

In the exemplary embodiment discussed herein, the second interlocking end 18*b* is simultaneously caused to traverse a similar ramp structure on the second flange until the second interlocking end 18*b* is forced into a similar seating structure on the second flange. Once the assembly of the first single piece connector 18 is complete, additional single piece connectors may be assembled onto the reel 10 in a similar manner. According to the embodiment described herein, a total of three single piece connectors are used. The use of three single piece connectors was found to strike an advantageous balance between strength and economy. Nevertheless, any number of single piece connectors may be used, depending on the strength and economy demands of the particular application.

Figure 6:
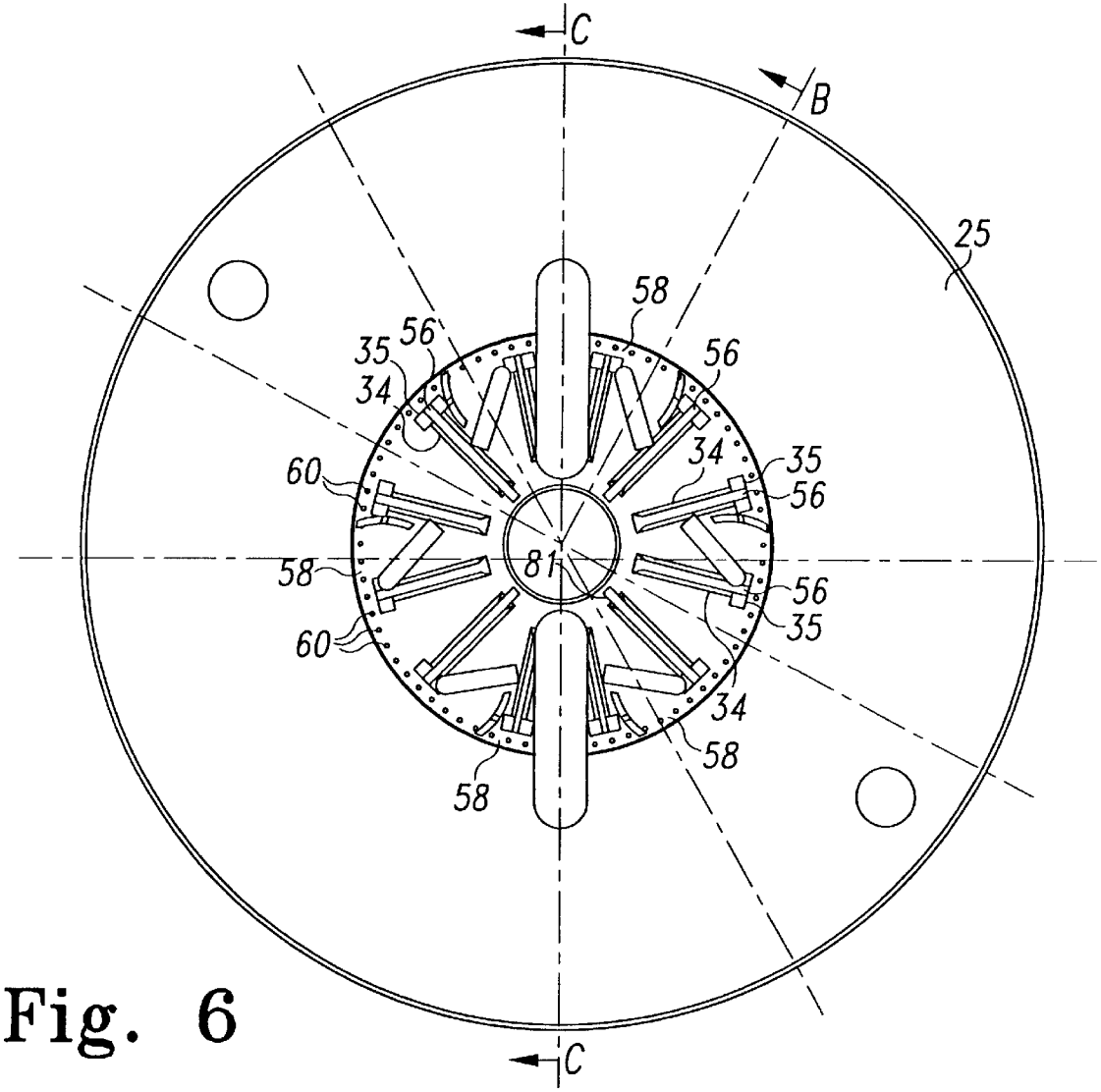
FIG. 6 illustrates the underside of the flange of the reel assembly of FIG. 1A.
Figure 7:
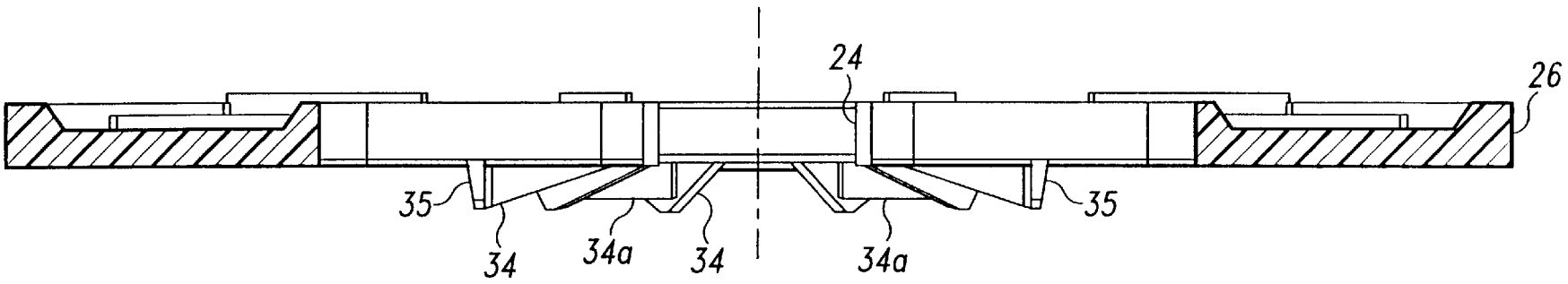
FIG. 7 illustrates cross section of the flange of FIG. 6.

Additional advantages of the present invention relate to the design of the flanges to includes means for preventing rotation of the flanges with respect to the core, which is a necessity for reel reliability in reel having a core with a circular cross section. To illustrate the rotation prevention features of the present invention, reference is made to FIGS. 2, 6 and 7. FIG. 6 illustrates the underside of the first flange 14, and FIG. 7 shows a cross sectional view of the first flange 14.

As discussed above, the underside of the first flange 14 includes a plurality of radially extending shoulders 34 that each terminate in a radial core engaging surface 35. As shown in FIGS. 1A and 5, the radial core engaging surfaces 35 engage the core inner surface 12*a*. Referring again to FIGS. 6 and 7, the first flange 14 further includes an axial core engaging surface 58 that is disposed outward of and adjacent to the plurality of radially extending shoulders 34. The axial core engaging surface 58 preferably includes a plurality of axially extending spikes 60. The axially extending spikes 60, which may suitably be conical in shape, engage the core 12 when the reel is assembled. Specifically, the axially extending spikes 60 either partially penetrate or at least deform the core 12 due to the tensile force of the single piece connectors 18, 20, and 21, that urges the first flange 14 toward the core 12. The partial penetration and or deformation of the core 12 by the spikes 60 inhibits movement of the core 12, or in other words, rotation of the core 12, with respect to the first flange 14.

To further inhibit core rotation, several, and preferably all of the radial core engaging surfaces 35 include a spline 56 that inclines from the axial core engaging surface 58 to the radial engaging surface 35. When the reel 10 is assembled (see FIG. 5), the splines 56 engage the core 12 and cause chording of the circular-shaped core 12. The chording inhibits rotation of the core 12 with respect to the first flange 14.

It will be noted that use of splines 56 on the radial core engaging surface 35 and the spikes 60 on the axial core engaging surface 58 represent a preferred embodiment. However, alternative embodiments may include other means for preventing rotation of the core which may be disposed on either the axial core engaging surface 58, the radial core engaging surface 35, or both. For example, the radial core engaging surface 35 may include a spike-like structure, or a hemispherical structure or other protrusion that assists in chording off the end of the core 12. Similarly, the axial core engaging means may include structures other than conical spikes, including protrusions of nearly any geometry which will tend to either penetrate or deform the core 12.

The core rotation prevention means of the present invention provide distinct advantages to reels having a circular core. Circular cores are convenient and desirable because, among other things, the circular core evenly distributes the load bearing forces, and provides a smooth, edgeless surface around which flexibly media such as wire may be wrapped. Accordingly, the core rotation prevention means of the present invention allows for the advantages that arise from the use of the circular core reel without suffering the disadvantages of core rotation that are normally associated with circular core reels.

The advantages provided by the core rotation prevention means of the present invention are not limited to reels employing single piece connectors such as the reel 10 described above. Any circular core reel that employs connecting means that connects the flanges to each other with the core disposed in between will benefit from the core rotation prevention means.

Yet another advantage of the present invention relates to the stacking of flanges in their unassembled state, in other words, not assembled to a core. The flange stacking features of the present invention are shown in FIG. 7. Referring to FIG. 7, At least some of the plurality of shoulders 34 have an extension 34*a* that projects axially outward the second side of the annulus 25 and extends radially inward to a location in registration with the outward most surface of the inner annular rim 24 (see FIG. 2). The extensions 34*a*, so constructed, are configured to engage the inner annular rim of another flange, not shown, that has a similar construction as the first flange 14 when the other similarly constructed flange is stacked in its unassembled state onto the first flange 14.

The extensions 34*a* facilitate reliable stacking of unassembled flanges, which greatly enhances the manufacturing, storage, and transport processes. Without the extensions 34*a*, stacked, unassembled flanges may readily slip off of the stack, and thus would require greater care in handling.

It will be understood that the above embodiments and configurations are given by way of example only. Those of ordinary skill in the art may readily devise their own implementations that incorporate the principles of the present invention and fall within the spirit and scope thereof.

We claim:

1. An apparatus for supporting wound flexible media comprising:

a first flange having at least one aperture and at least one protruding feature corresponding to said aperture;

a second flange having at least one aperture;

a core interposed between said first flange and said second flange;

at least one single piece connector having a first interlocking end and extending through the at least one aperture of the second flange and through the at least one aperture of the first flange, wherein said first interlocking end engages the protruding feature to inhibit a de-insertion alignment of the first interlocking end with the at least one aperture of the first flange.

2. The apparatus of claim 1 wherein said core includes an interior and said at least one single piece connector extends through said core interior.

3. The apparatus of claim 1 wherein said core comprises a hollow cylindrical core having an interior and said at least one single piece connector extends through said interior.

4. The apparatus of claim 1 wherein said interlocking end of said at least one single piece connector comprises an angular extension which engages said protruding feature.

5. The apparatus of claim 4 wherein each of at least one single piece connector comprises a steel rod, said steel rod having a bend forming said angular extension.

6. The apparatus of claim 1 wherein said second flange further comprises a protruding feature and said connector further comprises a second interlocking end, and wherein said second interlocking end engages said protruding feature of said second flange.

7. The apparatus of claim 1 wherein said protruding feature is integrally formed with said flange.

8. The apparatus of claim 1 wherein said protruding feature is securely affixed to said flange.

9. The apparatus of claim 1 wherein said first flange engages a first end of said core and said second flange engages a second end of said core.

10. An apparatus for supporting wound flexible media comprising:

a first flange having at least one aperture and at least one protruding feature integrally formed onto said first flange, said at least one protruding feature corresponding to the at least one aperture;

a second flange having at least one aperture;

a core interposed between said first flange and said second flange;

at least one single piece connector having a first interlocking end and extending through the at least one aperture of the second flange and through the at least one aperture of the first flange, wherein said first interlocking end engages the protruding feature.

11. The apparatus of claim 10 wherein said core includes an interior and said at least one single piece connector extends through said core interior.

12. The apparatus of claim 10 wherein said core comprises a hollow cylindrical core having an interior and said at least one single piece connector extends through said interior.

13. The apparatus of claim 10 wherein said interlocking end of said at least one single piece connector comprises an angular extension which engages said protruding feature.

14. The apparatus of claim 13 wherein each of at least one single piece connector comprises a steel rod, said steel rod having a bend forming said angular extension.

15. The apparatus of claim 10 wherein said second flange further comprises a protruding feature and said connector further comprises a second interlocking end, and wherein said second interlocking end engages said protruding feature of said second flange.

16. An apparatus for supporting wound flexible media comprising:

a core having first and second ends connected by a body around which flexible media may be wound;

first and second flanges, said first flange engaging said first core end and said second flange engaging said second core end, each flange having at least one aperture and at least one protruding feature corresponding to the at least one aperture, each protruding feature including a seating structure;

at least one single piece connector for securing said first and second flange to said core, said at least one single piece connector comprising a rod having first and second angular extensions defining first and second interlocking ends, said first interlocking end extending through the at least one aperture of the first flange and engaging the at least one protruding feature corresponding to the at least one aperture of the first flange such that the seating structure of the at least one protruding feature corresponding to the at least one aperture of the first flange receives the angular extension corresponding to the first interlocking end, said second interlocking end extending through the at least one aperture of the second flange and engaging the at least one protruding feature corresponding to the at least one aperture of the second flange such that the seating structure of the at least one protruding feature corresponding to the at least one aperture of the second flange receives the angular extension corresponding to the second interlocking end.

17. The apparatus of claim 16 wherein said core defines a hollow cylindrical structure.

18. The apparatus of claim 16 wherein the central core is constructed of corrugated paper material.

19. The apparatus of claim 18 wherein the flange is constructed of a composite material including plastic.

20. A method of constructing a reel comprising a core, first and second flanges, and at least one single piece connector having a first interlocking end, said method comprising:

a) disposing said core between said first flange and said second flange;

b) inserting the first interlocking end through, in sequence, an aperture in the second flange, an interior of the core body, and an aperture in the first flange, such that the first interlocking end extends outward the first flange; and c) causing the first interlocking end to traverse a protruding feature in the first flange to a position in which the protruding feature in the first flange inhibits the first interlocking end from de-insertion alignment with the aperture in the first flange.

21. The method of claim 20 wherein the single piece connector further includes a second interlocking end and step c) further comprises causing the second interlocking end to traverse a protruding feature in the second flange to a position in which the protruding feature in the second flange inhibits the second interlocking end from de-insertion alignment with the second aperture.

22. The method of claim 20 wherein the protruding feature of the first flange further comprises a ramp structure and step c) further comprises causing the first interlocking end to traverse the ramp structure.

23. An apparatus for supporting wound flexible media comprising:

a first flange having a radial core engaging surface and an axial core engaging surface;

a second flange having at least one aperture;

a core interposed between said first flange and said second flange, said core engaging the radial core engaging surface and the axial core engaging surface;

means for connecting the first flange to the second flange while said core is interposed between said first flange and second flange;

wherein said first flange further comprises means for preventing rotation of the first flange with respect to the core, said means for preventing rotation being disposed on at least one of the radial core engaging surface and the axial core engaging surface.

24. The apparatus of claim 23 wherein said means for preventing rotation includes axial extending spikes disposed on said axial core engaging surface.

25. The apparatus of claim 24 wherein said axially-extending spikes are integrally formed with said first flange.

26. The apparatus of claim 23 wherein said means for preventing rotation includes radially extending splines disposed on said radial core engaging surface.

27. The apparatus of claim 26 wherein said radially-extending splines are integrally formed with said first flange.

28. The apparatus of claim 26 wherein said means for preventing rotation further includes axially extending spikes disposed on said axial core engaging surface.

29. The apparatus of claim 28 wherein said axially extending spikes and said radially extending splines are integrally formed with said first flange.

30. The apparatus of claim 23 wherein said second flange includes a second flange radial core engaging surface, a second flange axial core engaging surface, and second flange means for preventing rotation of the second flange with respect to the core, said second flange means for preventing rotation disposed on one of the second flange radial core engaging surface and the second flange axial core engaging surface.

31. A flange for use in a reel assembly comprising a core disposed between two flanges, said flange comprising:

an annulus having at least one annular rim, said annular rim extending axially from a first side of the annulus;

at least one core engaging surface disposed on a second side of the annulus; and a plurality of ribs disposed on said first side of the annulus, said plurality of ribs having an axial height sufficient to engage a second flange annular rim that axially extends from a first side of a second flange to facilitate registration of a reel assembly including the flange with a second reel assembly including the second flange and to retain the reel assembly in registration with the second reel assembly.

32. The flange of claim 31 wherein said annular rim has a rim height, and axial height of the plurality of ribs exceeds the rim height.

33. The flange of claim 31 wherein said annular rim and said plurality of ribs are integrally formed with said annulus.

34. The flange of claim 31 wherein said annular rim is disposed on an outer annular edge of said annulus.

35. The flange of claim 31 further comprising a plurality of shoulders disposed on the second side of the annulus, said at least one of the plurality of shoulders each having an extension having an axial height sufficient to engage a corresponding annular rim on the first side of the second flange to facilitate stacking the flange with the second flange.

36. The flange of claim 35 further comprising a second annular rim disposed on the first side of the annulus for receiving at least one second flange shoulder extension disposed on the second side of the second flange.

37. The flange of claim 36 wherein said second annular rim is disposed on an inner edge of the annulus.

* * * * *